US006360716B1

(12) United States Patent
Bootle

(10) Patent No.: US 6,360,716 B1
(45) Date of Patent: Mar. 26, 2002

(54) GOVERNOR

(75) Inventor: Geoffrey David Bootle, Maidstone (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/656,621

(22) Filed: Sep. 7, 2000

(30) Foreign Application Priority Data

Sep. 7, 1999 (GB) ..... 9920953

(51) Int. Cl.[7] ..... F02D 1/04
(52) U.S. Cl. ..... 123/365; 123/364
(58) Field of Search ..... 123/364–374; 192/105 C

(56) References Cited

U.S. PATENT DOCUMENTS 4,508,489 A * 4/1985 Howes ..... 123/502 X
4,834,046 A * 5/1989 Krause et al. ..... 123/364

* cited by examiner

*Primary Examiner*—Tony M. Argenbright
(74) *Attorney, Agent, or Firm*—Thomas A. Twomey

(57) ABSTRACT

A governor for use in an engine, the governor including a drive shaft and a plurality of weights carried by the drive shaft. The weights are rotatable with the drive shaft and are moveable relative to the drive shaft. A lever is moveable in response to movement of the weights, the lever being moveable against the action of a return biasing arrangement. The governor further includes a further arrangement for holding at least one of the weights against movement so as to permit adjustment of the operating speed of the governor.

10 Claims, 3 Drawing Sheets

GOVERNOR

TECHNICAL FIELD

This invention relates to a governor for use in controlling the operation of a diesel engine. The invention is particularly applicable to engines used to drive alternator sets.

It is known to provide a mechanical governor to control the rate at which fuel is supplied to a compression ignition internal combustion engine for driving an alternator set, thereby permitting the alternator set to be driven at a substantially constant speed irrespective of the load on the engine. Such a governor typically comprises a plurality of weights which are pivotally mounted upon a drive shaft driven at a speed associated with the output speed of the engine. Typically, six weights are provided. The weights act upon a lever which is moveable against the action of a return spring. The lever is coupled to a metering valve of a fuel pump for use in supplying the engine with fuel under high pressure. The governor is arranged such that, in use, if the load on the engine falls, then the engine operating speed will increase. Such an increase in engine speed will cause the weights to pivot outwardly as a result of an increase in the magnitude of the centrifugal force acting upon the weights. The movement of the weights causes the lever to move, the movement of the lever, and hence the weights, occurring against the action of the return spring. The movement of the lever is transmitted to the metering valve, adjusting the metering valve to restrict the supply of fuel to the engine and reduce the engine speed. Similarly, a reduction in engine speed will cause the governor to operate to increase the rate at which fuel is supplied to the engine.

BACKGROUND OF THE INVENTION

A governor is usually designed to operate at a chosen speed, for example to cause the engine to drive an alternator set at 50 Hz or 60 Hz. Modification of a governor intended to operate at a first speed to operate at a second speed may require the throttle to be moved through a large distance, and the droop of the governor will not be constant at both speeds. Rather than adjust the position of the throttle, it is known to replace the governor spring or to modify the rate of the spring in some way.

It is an object of the invention to provide a governor, the operating speed of which can be adjusted without requiring the replacement of parts of the governor and without requiring a significant adjustment of the throttle position.

SUMMARY OF THE INVENTION

According to the present invention there is provided a governor comprising a drive shaft, a plurality of weights carried by the drive shaft, the weights being rotatable with the shaft and being moveable relative to the shaft, a lever moveable in response to movement of the weights, the lever being moveable against the action of return biasing means, and means whereby at least one of the weights can be held against movement to adjust the operating speed of the governor.

Conveniently, the weights may be pivotally moveable relative to the shaft, at least one of the weights being held against pivotal movement to adjust the operating speed of the governor.

Conveniently, six weights are provided, the weights and the return spring being chosen such that the governor operates at an alternator speed of 50 Hz. The governor is conveniently arranged such that two of the weights can be held against pivotal movement, under which circumstances the governor will operate at an alternator speed of approximately 61.2 Hz, and only a slight adjustment of the throttle will be necessary to ensure that the governor controls the associated engine to operate at an alternator speed of 60 Hz.

As there is no need to move the throttle through a large angle, the droop of the governor is not significantly altered when the governor is modified to operate at an alternative speed. Further, there is no need to replace components of the governor in order to change the operating speed.

The governor preferably includes a cage which is rotatable with the drive shaft, the weights being housed within the cage.

The weight(s) may be held against pivotal movement by, for example, wedges or pins, by jacking, by the use of pinch bolts, by use of a sliding collar or by any other suitable arrangement. For example, the governor may comprise at least one pin associated with each weight to be held against movement, whereby the or each pin cooperates with the cage to hold the associated weight against movement. Alternatively, a collar may be provided, the collar being slidably movable with respect to the drive shaft between an operative position, in which at least one of the weights is held against movement, and an inoperative position in which the weights are free to move.

Preferably, the return biasing means take the form of a return spring.

Conveniently, adjustment of the governor operating speed can be achieved without disassembling the pump housing, the adjustment being achieved, for example, by inserting a suitable tool through the pump housing drain port.

BRIEF DESCRIPTION OF THE DRAWINGS

The invention will further be described, by way of example, with reference to the accompanying drawings in which.

DESCRIPTION OF THE PREFERRED EMBODIMENT

The accompanying drawings illustrate a governor for use in controlling the operation of a compression ignition internal combustion engine intended to drive an alternator set. The governor controls the supply of fuel to a fuel pump associated with the engine in such a manner as to ensure that the engine drives the alternator at a substantially uniform speed.

Figure 1:
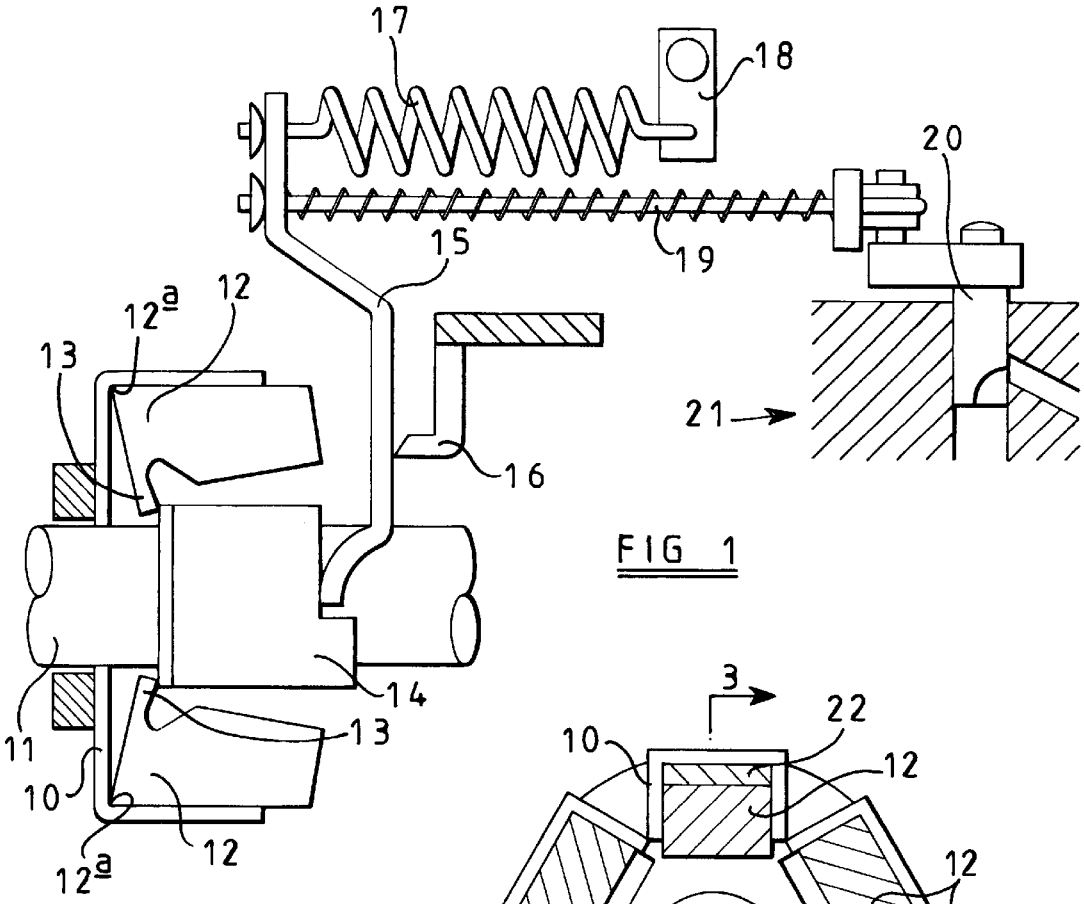
FIG. 1 is a diagrammatic sectional view illustrating a governor arrangement in accordance with an embodiment of the invention.

As illustrated in FIG. 1, the governor comprises a cage 10 rigidly mounted upon a drive shaft 11 which is driven to rotate at a speed associated with the operating speed of the associated engine. The cage 10 houses six weights 12, each of which is pivotable about a point 12*a* of the weight 12 relative to the cage 10. Each weight 12 further includes a toe 13 which engages an end of a sleeve 14 which encircles the drive shaft 11. The sleeve 14 is axially moveable relative to the drive shaft 11.

The end of the sleeve 14 remote from the weights 12 engages a lever 15 which is pivotable about a fulcrum 16. The lever 15 is coupled to a governor spring 17 which, in turn, is coupled to an angularly adjustable throttle lever 18. The lever 15 is further coupled using a conventional coupling arrangement 19, to an angularly adjustable metering valve member 20 of a metering valve 21 of a rotary distributor pump.

In use, the drive shaft 11 is driven at a speed associated with the engine operating speed, and hence the centrifugal forces experienced by the weights 12 are related to the engine operating speed. The position occupied by each weight 12 depends upon the engine operating speed and the magnitude of a restoring force transmitted thereto through the lever 15 and the sleeve 14 from the spring 17.

Starting from an equilibrium condition in which the engine is operating at a desired alternator speed, in this case 50 Hz, in the event that the load on the engine falls, then the engine operating speed will increase, and as a result the weights will tend to pivot outwardly, towards the position shown in FIG. 1, due to an increase in the magnitude of the centrifugal force experienced by the weights. The movement of the weights results in the toes 13 of the weights 12 pushing the sleeve 14 and lever 15 against the action of the spring 17. The movement of the lever 15 is transmitted through the coupling 19, adjusting the setting of the metering valve 21 to reduce the rate at which fuel is supplied to the pump, and hence to reduce the rate of fuel supply to the engine, compensating for the reduction in the load on the engine.

Similarly, starting from the equilibrium condition, in the event that the load on the engine increases, then the speed of operation of the engine, and hence the speed of the shaft 11, falls. The spring 17 is thus able to move the lever 15 and sleeve 14 to move the weights 12 towards a radially inner position against the action of a reduced centrifugal force experienced by the weights 12. The movement of the lever 15 is transmitted to the metering valve 21 to increase the rate of fuel supply to the pump and engine to compensate for the increased load on the engine.

In the event that the alternator speed when the governor occupies its equilibrium condition is not exactly 50 Hz, then the throttle lever 18 can be moved through a small angle to adjust the magnitude of the load applied by the spring 17.

Figure 2:
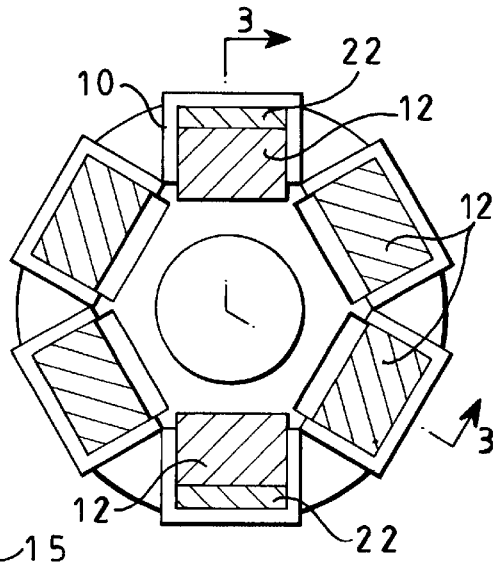
FIG. 2 is a sectional view illustrating the governor of FIG. 1 in an alternative mode of operation.
Figure 3:
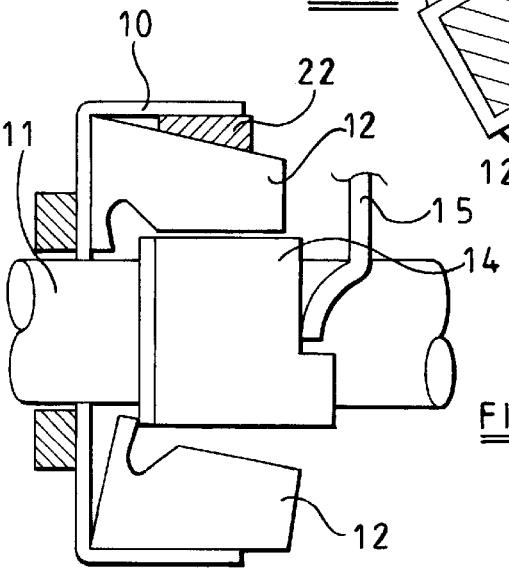
FIG. 3 is a sectional view along the line 3—3 of FIG. 2.

FIGS. 2 and 3 illustrate the governor of FIG. 1 when it is desired to run an engine with which the governor is associated at an alternator operating speed of 60 Hz rather than 50 Hz. As illustrated in FIG. 2, this is achieved by introducing wedges 22 between the cage 10 and two of the weights 12 to hold those two weights 12 in their radially inner position irrespective of the engine operating speed. The wedges 22 may be held in position simply by being a friction fit or by means of bolts or by any other suitable means. The provision of the wedges 22 effectively disables the associated weights 12 so that the centrifugal forces experienced by those weights 12 are not transmitted to the sleeve 14 and lever 15, and so play no part in controlling the position of the lever 15 or the setting of the metering valve 21.

Where the governor of FIG. 1 is set to control an associated engine to operate at an alternator speed of 50 Hz, then using the wedges 22 to disable two of the weights 12 will result in the governor controlling the engine to operate at an alternator speed of 61.2 Hz. If the desired alternator operating speed is 60 Hz, then a small adjustment of the throttle lever position can be made to result in the governor controlling the engine to ensure that the alternator operates at a speed of approximately 60 Hz.

As the throttle lever 18 does not need to be moved through a large angle to change the operating speed, the responsiveness or droop of the system is not significantly altered by the change in equilibrium operating speed. Further, as no parts of the governor need to be replaced to change the operating speed, alteration of the operating speed is a simple procedure. The step of disabling the weights 12 is conveniently achieved through a drain part provided in the pump/governor housing, in which case the operation of modifying the operating speed does not entail disassembling the pump/governor.

Figure 4:
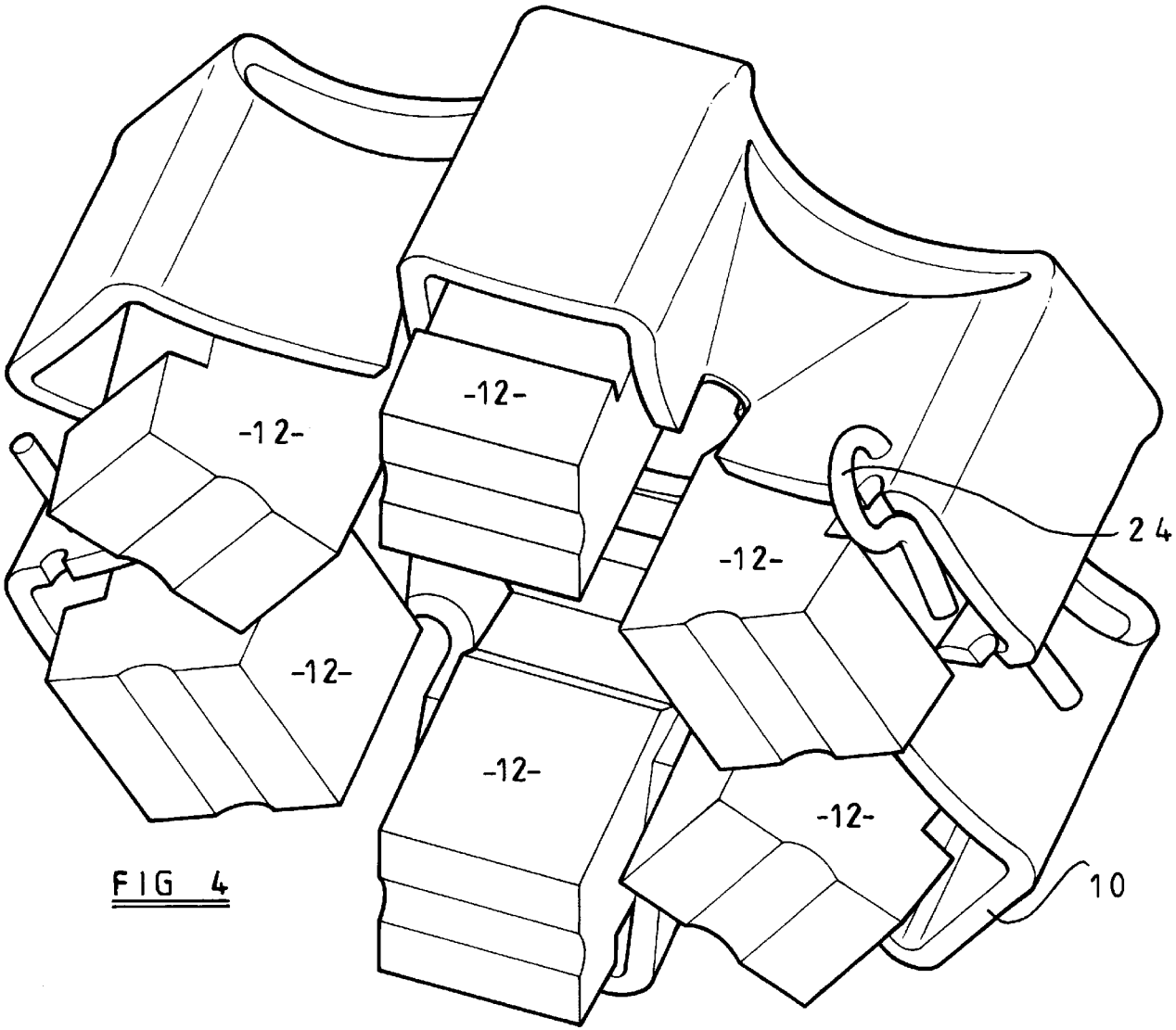
FIG. 4 is a perspective view of an alternative embodiment of the invention.
Figure 5:
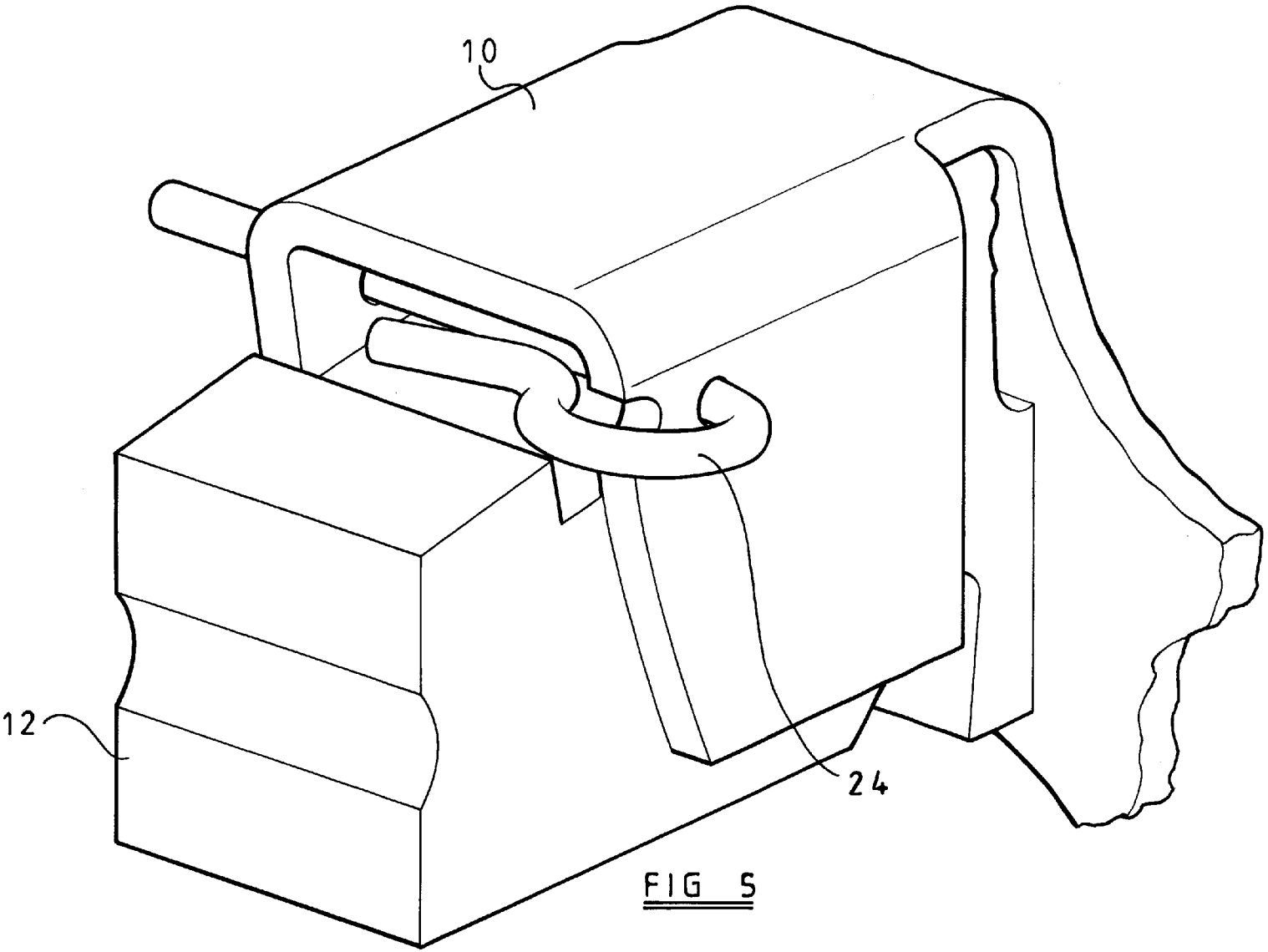
FIG. 5 is a perspective view of a part of the governor in FIG. 4.

Although in the description hereinbefore, the weights are disabled using wedges, it will be appreciated that other techniques could be used to disable the weights. With reference to FIGS. 4 and 5, pins 24 may be introduced into the cage 10 to hold the weights 12 in their inner positions. In the illustration shown in FIGS. 4 and 5, only a single pin 24 is shown, but it will be appreciated that any one or more of the weights 12 may have an associated pin 24, the pin 24 cooperating with the cage 10 so as to hold the associated weight 12 against movement. It will further be appreciated that more than one pin 24 may be associated with each weight 12, if desired.

In a further alternative embodiment of the invention (not shown in the accompanying drawings), pinch bolts could be used to hold the weights in their inner positions. As a still further alternative, a collar could be provided around the shaft 11 or sleeve 14, the collar being slidable between an inoperative position in which it does not affect the operation of the governor, and an operative position in which it holds some of the weights in their inner positions, disabling those weights.

In the description hereinbefore the governor has six weights, two of which can be disabled to permit operation at either approximately 50 Hz or approximately 60 Hz. It will be appreciated, however, that the invention is also applicable to governors having other numbers of weights, and is not limited to arrangements in which two weights can be disabled. The invention is therefore suitable for use with governors intended to operate at other speeds.

What is claimed is:

1. A governor for use in an engine, the governor comprising a drive shaft, a plurality of weights carried by the drive shaft, the weights being rotatable with the drive shaft and being moveable relative to the drive shaft, a lever moveable in response to movement of the weights, the lever being moveable against the action of a return biasing arrangement and a further arrangement for holding at least one of the weights against movement so as to permit adjustment of the operating speed of the governor.

2. The governor as claimed in claim 1, wherein the weights are pivotally moveable relative to the drive shaft and whereby at least one of the weights is held against pivotal movement to adjust the operating speed of the governor.

3. The governor as claimed in claim 1, wherein the engine is arranged to drive an alternator, in use, the governor comprising six weights, the weights and the return biasing arrangement being chosen such that the governor operates at an alternator speed of substantially 50 Hz.

4. Then governor as claimed in claim 3, wherein the governor is arranged such that two of the weights can be held against pivotal movement.

5. The governor as claimed in claim 1, comprising a cage which is rotatable with the drive shaft, the weights being housed within the cage.

6. The governor as claimed in claim 1, wherein the further arrangement for holding at least one of the weights against movement comprises a wedge associated with each of the weights to be held against movement.

7. The governor as claimed in claim 6, wherein the or each wedge is held in place by means of a bolt arrangement.

8. The governor as claimed in claim 5, wherein the further arrangement for holding at least one of the weights against movement comprises at least one pin associated with each weight to be held against movement, whereby the or each pin cooperates with the cage to hold the associated weight against movement.

9. The governor as claimed in claim 1, wherein the further arrangement for holding at least one of the weights against movement comprises a collar which is slidably movable with respect to the drive shaft between an operative position, in which at least one of the weights is held against movement, and an inoperative position in which the weights are free to move.

10. The governor as claimed in claim 1, wherein the return biasing arrangement takes the form of a return spring.

* * * * *